United States Patent [19]

Kay

[11] Patent Number: 4,746,838

[45] Date of Patent: May 24, 1988

[54] INK FOR FORMING RESISTIVE STRUCTURES AND DISPLAY PANEL CONTAINING THE SAME

[75] Inventor: Nicholas W. Kay, Medford, N.J.

[73] Assignee: Telegenix, Inc., Cherry Hill, N.J.

[21] Appl. No.: 890,470

[22] Filed: Jul. 30, 1986

[51] Int. Cl.[4] ..... H01J 17/00

[52] U.S. Cl. ..... 313/519; 338/307; 338/308; 338/224; 252/513; 252/514; 313/582; 313/589; 501/19; 501/20; 445/24

[58] Field of Search ..... 252/513, 514, 518, 519; 338/308, 307, 224; 315/169.2, 169.3; 313/582, 584, 591, 517, 519; 340/758, 759; 501/19, 20

[56] References Cited

U.S. PATENT DOCUMENTS

| | | | |
|---|---|---|---|
| 3,865,742 | 2/1975 | Greenstein | 338/226 |
| 4,122,232 | 10/1978 | Kuo | 252/512 |
| 4,433,269 | 2/1984 | Kay | 252/514 X |
| 4,496,475 | 1/1985 | Abrams | 252/514 |
| 4,520,290 | 5/1985 | Cokefair | 313/582 X |
| 4,561,996 | 12/1985 | Holmes et al. | 252/514 |

*Primary Examiner*—David K. Moore
*Assistant Examiner*—Mark R. Powell
*Attorney, Agent, or Firm*—Robert A. Green

[57] ABSTRACT

An ink for use in forming resistive structures for use in a gas discharge display panel containing mercury vapor to inhibit cathode sputtering, the ink comprising a mixture of silver and nickel with the nickel being controllably oxidized to impart the desired resistivity to the mixture and the final resistive body in the display panel.

10 Claims, 1 Drawing Sheet

INK FOR FORMING RESISTIVE STRUCTURES AND DISPLAY PANEL CONTAINING THE SAME

BACKGROUND OF THE INVENTION

There are many types of electronic devices which use resistive structures for various reasons. One type of device is a gas discharge display panel described herein and in copending application Ser. No. 890,471 of Edgar L. Harvey filed concurrently herewith. Various methods are known for making conductive or resistive structures or runs and materials are known for making them. However, these known methods using known materials, are relatively inexact, and time-consuming trimming operations are required to achieve the desired resistivity or conductivity. The present invention provides a resistive structure whose resistivity or conductivity can be well controlled so that complex and time consuming procedures are not required to achieve a desired resistivity in the final product.

DESCRIPTION OF THE INVENTION

Figure 1:
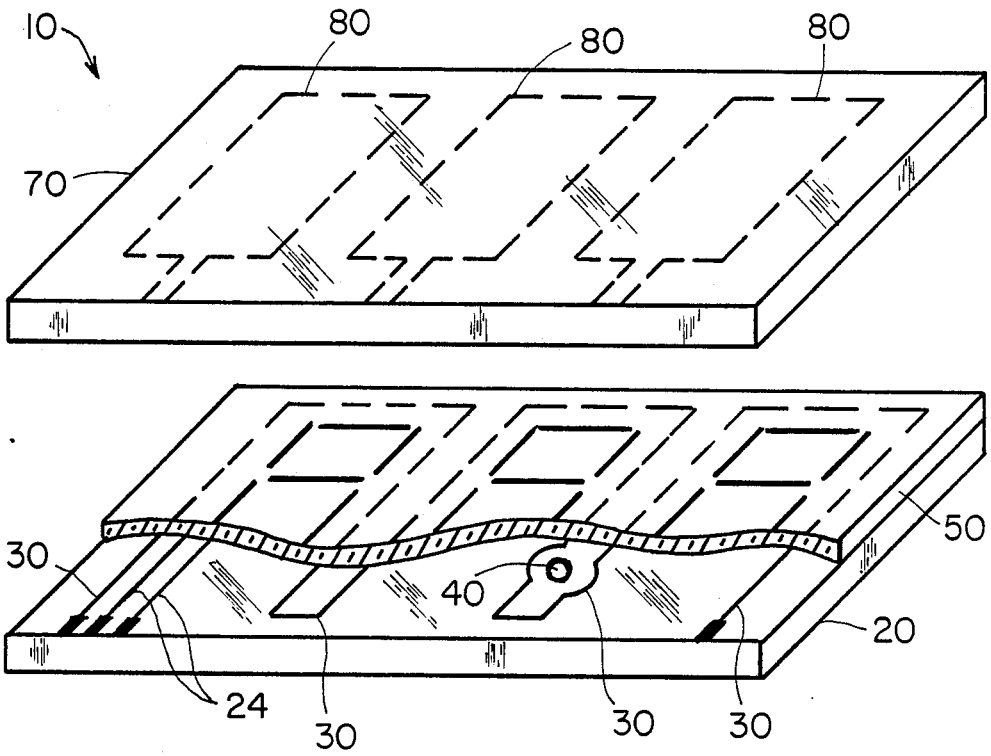
FIG. 1 is a perspective exploded view of type of display panel which uses the invention.
Figure 2:
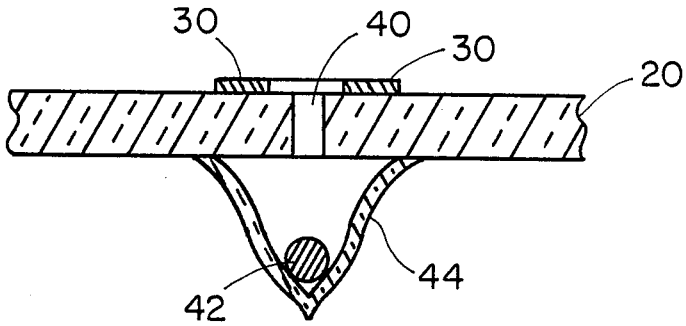
FIG. 2 is a sectional view through the tubulation attached to the panel of FIG. 1.

The ink of the invention is particularly suited for forming resistive bodies in a display panel of the type described and claimed in patent application Ser. No. 890,471, filed concurrently herewith by Edgar L. Harvey. Briefly referring to FIGS. 1 and 2, this panel 10 includes a substrate or base plate 20 having a top surface 22 on which conductive runs 24 (only some of which are shown) for making connection to the cathodes are formed and on which the desired resistive body 30 is formed. The runs 24 and resistive body 30 can be formed on the top surface and suitably interleaved or the resistive body can be formed first, then coated with an insulating layer and then the cathode runs formed. The aforementioned Harvey application describes one suitable arrangment of these portions of the panel.

The resistive body 30, in one form, is a continuous line-like resistor made up of a plurality of segments which run back and forth across the base plate so that portions thereof are close to the seal area of the panel and other portions curve around and are close to the tubulation hole 40 through which mercury vapor enters the interior of the panel from a mercury supply 42 in a tubulation 44 secured to the base plate in alignment with the hole 40.

The cathode runs 24 are formed by a screening and firing operation and the resistor run 30 is also formed by a screening and firing operation as described in detail below.

An insulating layer 50 covers the resistive run 30 and the cathode connector runs 24 if they are on the top surface of the base plate and this layer 50 is formed by screening and then firing.

Groups of cathode segments 60 are screened on the insulating layer 50 and make connection to their runs 24 through vias (not shown) in the insulating layer. The cathodes 60 are also processed by a baking operation and another insulating layer is usually provided on the groups of cathodes to outline them. This too involves a firing operation. This layer and other features are not shown to simplify the drawings since they are well known in the art.

The panel 10 includes a glass face plate 70 which carries transparent conductive anodes 80 on its inner surface with each anode overlying a group of cathode segments 60.

After the face plate 70 and base plate 20 are sealed together hermetically, the panel is processed to completion and this processing includes filling the panel envelope with an ionizable gas, such as neon or argon or the like, through the tubulation 44 and providing a source of mercury 42 in the tubulation from which mercury vapor is introduced into the envelope to minimize cathode sputtering when the cathodes glow during panel operation.

Briefly, the material or "ink" of the invention which is used to make the resistor run 30 includes a plurality of metal elements in such form that when the material is placed on a substrate and the substrate is incorporated in a display panel by a process which includes several heating operations, the final body of resistance material has the desired resistance or very close to the desired resistance. The processing steps used in making the panel include several heating operations and the resistive body is formed early in the assembly process and it is able to accept all of the subsequent heating operations without having its resistance seriously affected.

In brief, the material or ink of the invention comprises a combination of (1) a conductive component containing silver which is normally fired in air to maintain its conductivity and (2) a conductive component containing nickel which is normally fired in nitrogen to retain its conductivity but which oxidizes when fired in air. The mixture of the two components is first fired in air in a controlled manner so that the nickel is controllably oxidized and then any additional heating is carried out in a nitrogen atmosphere. The resultant resistive body has a closely predetermined resistance.

In the foregoing material, the nickel is in the form of a powder having a particle size in the range of about two to about ten microns. This particles size provides the optimum nickel surface for oxidation during the processing operation to achieve the desired resistance.

The silver component is made up of a combination of silver flakes and silver powder. This use of flakes and powder also combines with the nickel powder to provide optimum packing of the silver and the nickel and optimum control of the overall conductivity of the final resistive body as it undergoes multiple firings during the manufacture of the panel. In the silver component, the silver powder has a particle size in the range of about 0.8 microns to about 1.2 microns. The silver flakes are less than about ten microns in length.

The glass frit used in the ink of the invention is a low temperature binder glass which serves to insure proper wetting of the nickel and silver in the firing process used in forming the resistive body. The glass frit preferably has a melting point in the range of about 440° C. to about 460° C.

The ink also includes a vehicle which is not a critical constituent and is provided to impart proper screening characteristics to the ink.

Typical ink compositions embodying the invention include:

| Constituent | Weight % |
|---|---|
| Silver Flake | 20–30 |

-continued

| Constituent | Weight % |
|---|---|
| Silver Powder | 15–25 |
| Spherical Nickel Powder | 10–30 |
| Glass Frit | 20–25 |
| Vehicle | 13–20 |

Another ink composition according to the invention includes a silver cermet (silver and a glass frit) and a nickel cermet (nickel and a glass frit). The silver cermet includes 70% silver (35% flakes and 35% powder) and 30% glass frit. The nickel cermet includes 85% spherical nickel powder and 15% glass and the following are some mixes of these two cermets for obtaining the indicated resistances in a resistor run which is 48" long, 25 microns thick and 20 mils wide:

| about 10 ohms | about 20 ohms | about 30 ohms | about 40 ohms |
|---|---|---|---|
| 15% nickel cermet | 20% nickel cermet | 25% nickel | 30% nickel |
| 85% silver cermet | 80% silver cermet | 75% silver | 70% silver |

The vehicle used in the ink of the invention is typically an ethyl cellulose/ester alcohol vehicle.

The ink is made in a generally conventional manner including suitable mixing and blending operations and, to form the desired resistive body, the ink is screened on a substrate. After screening, the substrate is fired in air to remove binders and primarily to oxidize the nickel. The firing time and temperature are selected to achieve the desired oxidation of the nickel and the resistance caused by the oxidation can be measured as the firing operation proceeds. After the desired resistance is achieved, the air firing is discontinued.

What is claimed is:

1. An ink for use in forming resistor structures comprising a mixture of two compositions one of which includes silver and the other of which includes nickel, the nickel having the characteristic of becoming resistive when fired in air, said silver being in the form of flakes and powder and said nickel being in the form of a spherical powder, said resistor structure formed of said ink being adapted for use in a gas display device.

2. The ink defined in claim 1 and including a glass frit binder and a vehicle for imparting desirable screening characteristic to the ink.

3. The ink defined in claim 2 wherein said glass frit is a low-temperature glass frit.

4. The ink defined in claim 1 wherein the quantities of each of silver and nickel are selected in accordance with the desired resistance of the resistive body to be prepared.

5. The ink defined in claim 1 wherein the nickel component is present as about 15% to 30% by weight of the ink and the silver component correspondingly is present as about 85% to 70% of the ink.

6. A material for use in forming resistive bodies for a gas-filled display panel comprising a first component including nickel in the form of a powder, a second component including silver in both flake form and powder form, a binder comprising a glass frit, and a vehicle for imparting body to the material so that it can be screened.

7. An ink for use in forming resistor structures for a gas-filled display panel comprising a mixture of two cermets one of which includes silver and a glass frit and the other of which includes nickel and a glass frit, the nickel having the characteristic of becoming resistive when fired in air, said silver being in the form of flakes and powder, and said nickel is in the form of a spherical powder.

8. A gas discharge display panel including a gas-filled envelope including an ionizable gas capable of sustaining cathode glow, said gas containing mercury vapor, said envelope including a glass base plate and a glass face plate, at least one glow cathode and an anode inside said envelope in operative relation with each other, and a resistor formed inside said envelope usable to generate heat electrically inside said envelope to keep the mercury in the gas vaporized, said resistor made up of a mixture of silver and nickel with the nickel being controllably oxidized immediately after formation of the body of said mixture which is to become said resistor to impart resistivity to said mixture.

9. The method of forming a resistor body for use in a gas-filled display panel having cathode electrodes which glow comprising the steps of providing a base plate having a top surface, forming an ink mixture including silver in the form of flakes and powder and nickel in the form of a spherical powder, depositing a quantity of said ink mixture on said top surface of said base plate, and controllably heating said base plate in air to oxidize the nickel component of said mixture to render said quantity of ink on said base plate resistive.

10. The method of making a display panel comprising the steps of providing a glass base plate having a top surface, forming an ink mixture including silver in the form of flakes and powder and nickel in the form of a spherical powder, depositing a quantity of said ink mixture in a desired pattern on the top surface of said base plate, controllably heating said base plate in air to oxidize the nickel component of said mixture to impart resistance to said mixture and to said pattern of said ink, providing a layer of insulating material and an array of cathode electrodes on said base plate, heating said base plate with said oxidized resistive ink and said layers of insulating material and said cathode electrodes in nitrogen whereby desired processing is achieved without affecting the resistance of said pattern of resistive material, and securing a face plate to said base plate to form a gas-tight envelope and filling said envelope with an ionizable gas and processing the panel to completion without the use of heating in air.

* * * * *